US008650800B2

(12) United States Patent
Anderson

(10) Patent No.: US 8,650,800 B2
(45) Date of Patent: Feb. 18, 2014

(54) WINDOW LIFT ASSEMBLIES FOR VEHICLES INCLUDING WINDOW SUPPORT BRACKET ASSEMBLIES

(75) Inventor: Chad Eric Anderson, Ypsilanti, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 0 days.

(21) Appl. No.: 13/416,013

(22) Filed: Mar. 9, 2012

(65) Prior Publication Data

US 2013/0232879 A1 Sep. 12, 2013

(51) Int. Cl.
*E05F 15/16* (2006.01)

(52) U.S. Cl.
USPC ..... 49/351; 49/375

(58) Field of Classification Search
USPC ..... 49/348, 349, 350, 351, 372, 374, 375
See application file for complete search history.

(56) References Cited

U.S. PATENT DOCUMENTS

| | | | | |
|---|---|---|---|---|
| 2,033,778 | A | 3/1936 | Miller | |
| 2,033,874 | A | 3/1936 | Ball | |
| 2,053,936 | A | 9/1936 | Ball | |
| 2,053,937 | A | 9/1936 | Ball | |
| 2,860,873 | A | 11/1958 | Miles, Jr. | |
| 2,899,832 | A | 8/1959 | Meyer | |
| 3,050,322 | A | 8/1962 | Miller | |
| 3,252,256 | A * | 5/1966 | Sprecher | 49/351 |
| 3,646,707 | A * | 3/1972 | Lystad | 49/227 |
| 4,811,519 | A * | 3/1989 | Gold | 49/375 |
| 4,825,594 | A * | 5/1989 | Escaravage | 49/351 |
| 5,050,348 | A * | 9/1991 | Kane et al. | 49/351 |
| 5,101,596 | A * | 4/1992 | Moore | 49/351 |
| 5,113,620 | A * | 5/1992 | Guillaume et al. | 49/375 |
| 5,243,785 | A * | 9/1993 | Nieboer et al. | 49/375 |
| 5,513,468 | A * | 5/1996 | Diestelmeier | 49/375 |
| 6,041,549 | A * | 3/2000 | Schust et al. | 49/375 |
| 6,330,764 | B1 * | 12/2001 | Klosterman | 49/375 |
| 6,502,352 | B1 * | 1/2003 | Bonduel | 49/26 |
| 7,877,932 | B2 | 2/2011 | Kriese et al. | |
| 8,069,611 | B2 * | 12/2011 | Kitayama | 49/348 |
| 2004/0111970 | A1 | 6/2004 | Fenelon | |
| 2005/0160675 | A1 | 7/2005 | Fenelon | |
| 2006/0010775 | A1 | 1/2006 | Tao et al. | |
| 2007/1025000 | | 6/2007 | Fenelon | |

FOREIGN PATENT DOCUMENTS

| | | | | |
|---|---|---|---|---|
| EP | 369853 | A1 * | 5/1990 | E05F 11/44 |

* cited by examiner

*Primary Examiner* — Jerry Redman
(74) *Attorney, Agent, or Firm* — Dinsmore & Shohl LLP

(57) ABSTRACT

A window lift assembly for moving a vehicle window includes a window regulator assembly including an actuator that moves the vehicle window between raised and lowered positions. A window support bracket assembly connects the vehicle window and the window regulator assembly. The window support bracket assembly includes a window support that supports the vehicle window. The window support includes an outboard side and an inboard side. A support bracket is connected to the window support. The support bracket includes a window support connecting portion connected to the inboard side of the window support and a lift arm bracket connecting portion extends below a bottom of the window support. An underhang portion is connected to the window support connecting portion at an inner bend and is connected to the lift arm bracket connecting portion at an outer bend.

20 Claims, 5 Drawing Sheets

WINDOW LIFT ASSEMBLIES FOR VEHICLES INCLUDING WINDOW SUPPORT BRACKET ASSEMBLIES

TECHNICAL FIELD

The present specification generally relates to window lift assemblies and, more particularly, to window lift assemblies including window support bracket assemblies that support windows.

BACKGROUND

Window lift assemblies are often used in vehicles for raising and lowering of windows between open and closed positions using an actuator, such as a motor. Window regulators for use in automobiles often include a link mechanism or wire mechanism mounted in a door and coupled to a bracket fixed to a panel of window glass attached the door. When raising or lowering the window glass, the link mechanism or wire is moved by a motor-driven actuator to impart vertical movement to the bracket and the window glass connected thereto. With moving components raising and lowering within the door, clearance needs to be provided between the moving components and the stationary components located within the door in order to reduce or prevent any interference to movement of the moving components.

SUMMARY

In one embodiment, a window lift assembly for moving a vehicle window includes a window regulator assembly including an actuator that moves the vehicle window between raised and lowered positions. A window support bracket assembly connects the vehicle window and the window regulator assembly. The window support bracket assembly includes a window support that supports the vehicle window. The window support includes an outboard side and an inboard side. A support bracket is connected to the window support. The support bracket includes a window support connecting portion connected to the inboard side of the window support and a lift arm bracket connecting portion extends below a bottom of the window support. An underhang portion is connected to the window support connecting portion at an inner bend and is connected to the lift arm bracket connecting portion at an outer bend.

In another embodiment, a vehicle includes a door assembly including a door handle assembly and a vehicle window. A window lift assembly moves the vehicle window. The window lift assembly includes a window regulator assembly including an actuator that moves the vehicle window between raised and lowered positions. A window support bracket assembly connects the vehicle window and the window regulator assembly. The window support bracket assembly includes a window support that supports the vehicle window. The window support includes an outboard side and an inboard side. A support bracket is connected to the window support. The support bracket includes a window support connecting portion connected to the inboard side of the window support and a lift arm bracket connecting portion extends below a bottom of the window support. An underhang portion is connected to the window support connecting portion at an inner bend and is connected to the lift arm bracket connecting portion at an outer bend.

In another embodiment, a window lift assembly for moving a vehicle window includes a window regulator assembly including an actuator that moves the vehicle window between raised and lowered positions. A window support bracket assembly connects the vehicle window and the window regulator assembly. The window support bracket assembly includes a window support that supports the vehicle window. The window support includes an outboard side and an inboard side. A support bracket is connected to the window support. The support bracket includes a window support connecting portion connected to the inboard side of the window support. A lift arm bracket connecting portion extends below a bottom of the window support. The lift arm bracket connecting portion is offset from the window support connecting portion toward the outboard side of the window support such that the lift arm bracket connecting portion is located between the outboard and inboard sides of the window support.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments described herein generally relate to window lift assemblies for vehicles used to move vehicle windows between raised and lowered (i.e., open and closed) positions. The window lift assemblies include a window regulator assembly located within a door assembly of the vehicle that is connected to a window support bracket assembly. The window support bracket assembly, in turn, supports the vehicle window. The window support bracket assembly is shaped and sized to provide clearance between the window support bracket assembly and components within the door assembly, while providing suitable support for the vehicle window as the vehicle window is moved between the raised and lowered positions using the window regulator assembly.

Figure 1:
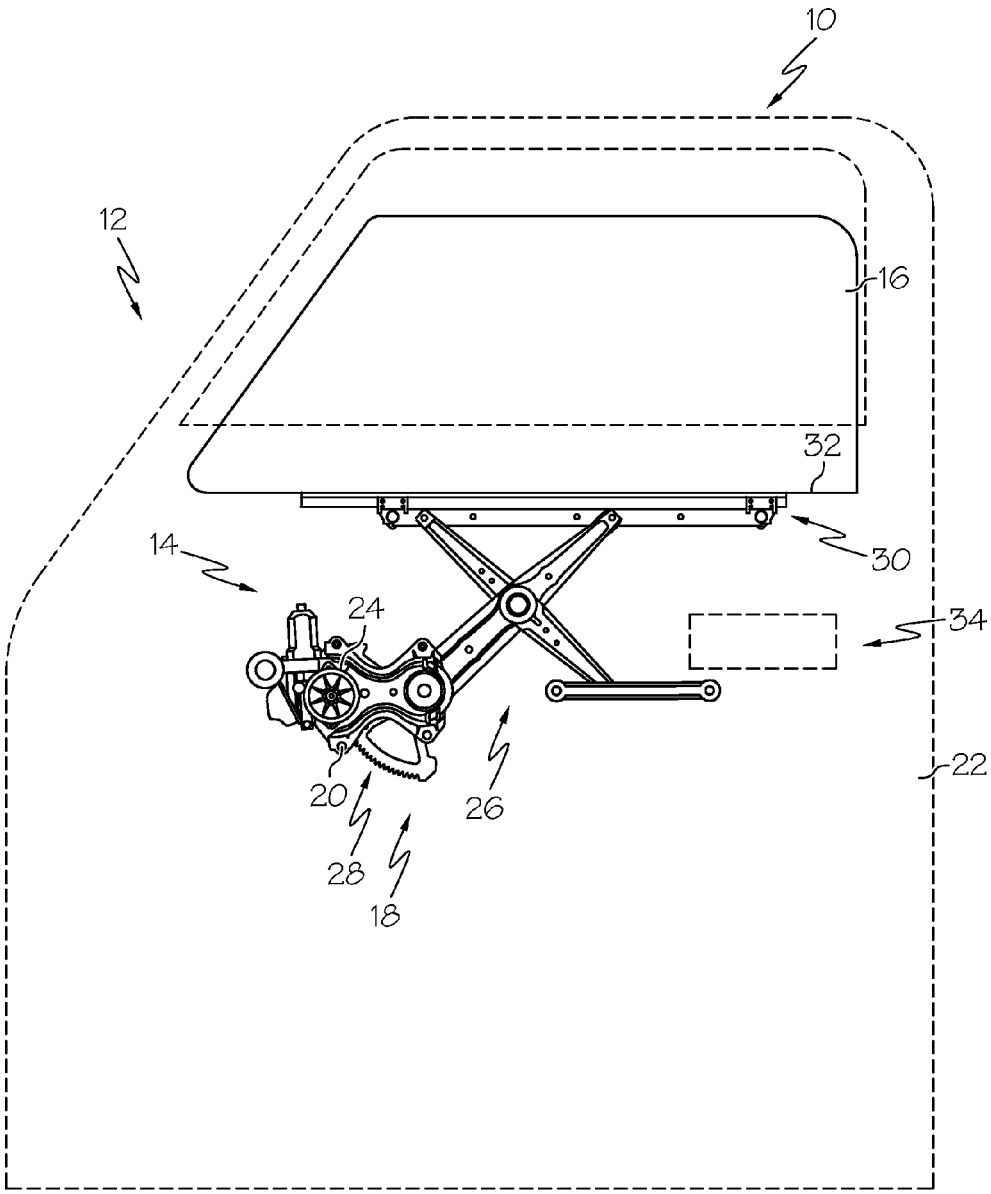
FIG. 1 is a schematic view of a door assembly including a window lift assembly according to one or more embodiments described herein.

Referring to FIG. 1, a door assembly 10 of a vehicle 12 includes a window lift assembly 14. The window lift assembly 14 is used to move a vehicle window 16 (e.g., a laminate glass) between raised and lowered positions. The window lift assembly 14 includes a window regulator assembly 18. The window regulator assembly 18 includes a mounting portion 20, which is mounted to an inner panel 22 of the door assembly 10 (e.g., using fasteners or any other suitable mounting structures), a motor-driven actuator 24 connected to the mounting portion 20 and a lift arm assembly 26 operatively connected to the motor-driven actuator 24 for moving the lift arm assembly 26 between raised and lowered positions. The motor-driven actuator 24 may be connected to the lift arm assembly 26 via a gear and pinion arrangement 28 capable of moving the lift arm assembly 26 in response to rotary output of the motor-driven actuator 24. Any suitable gearing arrangement may be used for moving the lift arm assembly 26.

The lift arm assembly 26 is connected to the vehicle window 16 by a window support bracket assembly 30. The window support bracket assembly 30 may support the vehicle window 16 in an upright, vertical position along a bottom edge 32 of the vehicle window 16. As will be described in greater detail below, the window support bracket assembly 30 is shaped and sized to provide clearance between the window support bracket assembly 30 and components within the door assembly 10, while providing suitable support for the vehicle window 16 as the vehicle window 16 is moved between the raised and lowered positions using the window regulator assembly 18. For example, a door handle assembly 34 may be provided for opening and closing the door assembly 10. The window support bracket assembly 30 may be sized and shaped to pass by the door handle assembly 34 without contacting the door handle assembly 34, while providing support for the vehicle window 16.

Figure 2:
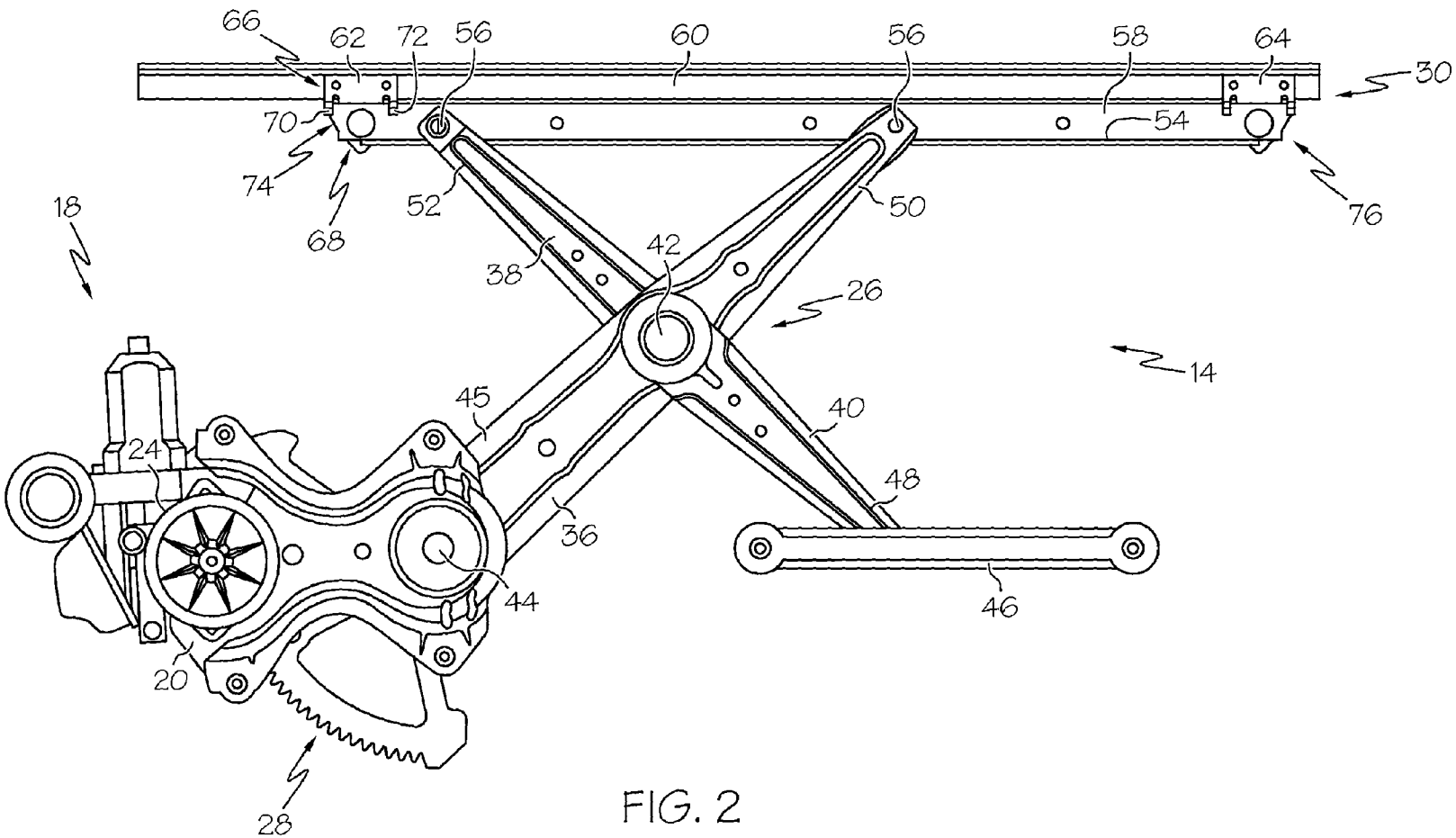
FIG. 2 illustrates the window lift assembly of FIG. 1 in isolation.

Referring to FIG. 2, the window lift assembly 14 is illustrated in isolation including the window regulator assembly 18 and the window support bracket assembly 30. The window regulator assembly 18 includes the lift arm assembly 26 operatively connected to the motor-driven actuator 24 via the gear and pinion arrangement 28. The lift arm assembly 26 includes a lift arm 36 and a pair of equalizer arms 38 and 40 that are pivotally connected to the lift arm 36 at a pivot 42. Another pivot 44 is provided at one end 45 of the lift arm 36 to allow the lift arm 36 to rotate relative to the mounting portion 20. In some embodiments, the equalizer arms 38 and 40 may be affixed to the same pivot 42 so that they remain aligned as they rotate. An equalizer bracket 46 may be provided for cooperating with the equalizer arms 38 and 40. The equalizer bracket 46 may include a guide track along which an end 48 of the equalizer arm 40 can move. The equalizer arms 38 and 40 may also be permitted to rotate relative to the equalizer bracket 46. Thus, the equalizer arms 38 and 40 can be freely guided horizontally within the guide track of the equalizer bracket 46, while allowing pivoting of the equalizer arms 38 and 40 relative to the equalizer bracket 46.

Ends 50 and 52 of the lift arm 36 and the equalizer arm 38 are slidably and rotatably connected to a lift arm bracket 54. The ends 50 and 52 may be pivotally connected to a race member 56 that is slidably received within a guide track 58 extending along a length of the lift arm bracket 54. Thus, the lift arm 36 and the equalizer arm 38 can be freely guided horizontally within the guide track 58 of the lift arm bracket 54, while allowing pivoting of the lift and equalizer arms 36 and 38 relative to the equalizer bracket 46.

The window support bracket assembly 30 is connected to the lift arm bracket 54 for movement with the lift arm bracket 54. The window support bracket assembly 30 includes a window support 60 that extends along the length of the lift arm bracket 54 and support brackets 62 and 64 that connect the window support 60 to the lift arm bracket 54. In some embodiments, the window support 60 has a length that is longer than a length of the lift arm bracket 54 and the support brackets 62 and 64 are spaced-apart along the lengths of the window support 60 and the lift arm bracket 54. In other embodiments, the window support 60 may be about the same length or shorter than the lift arm bracket 54.

Figure 3:
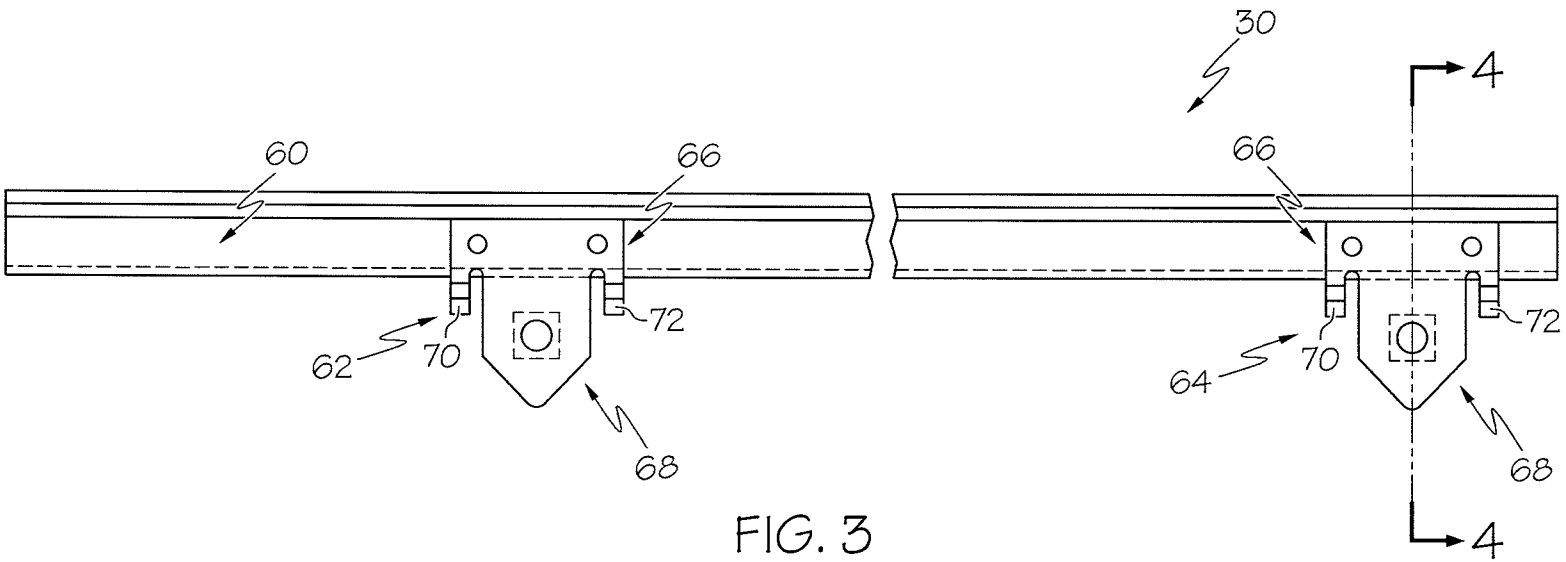
FIG. 3 illustrates a window support bracket assembly for use in the window lift assembly of FIG. 2 according to one or more embodiments described herein.

Referring to FIG. 3, the window support bracket assembly 30 is illustrated in isolation and includes the window support 60 and the support brackets 62 and 64 spaced-apart from each other along the length of the window support 60. Each support bracket 62 and 64 includes a window support connecting portion 66 that connects to the window support 60 and a lift arm bracket connecting portion 68 that connects to the lift arm bracket 54. Tabs 70 and 72 extend from the window support connecting portion 66 and are located at opposite sides of the lift arm bracket connecting portion 68. The tabs 70 and 72 may be used to position the support brackets 62 and 64 on the lift arm bracket 54 before fastening or otherwise affixing the support brackets 62 and 64 to the lift arm bracket 54. Such a tab arrangement is shown in FIG. 2 where the lift arm bracket connecting portion 68 is located behind the lift arm bracket 54 and the tabs 70 and 72 are located on the opposite front side of the lift arm bracket 54 such that the tabs 70 and 72 and the lift arm bracket connecting portion 68 straddle outer wall portions 74 and 76 of the lift arm bracket 54 for connection thereto.

Figure 4:
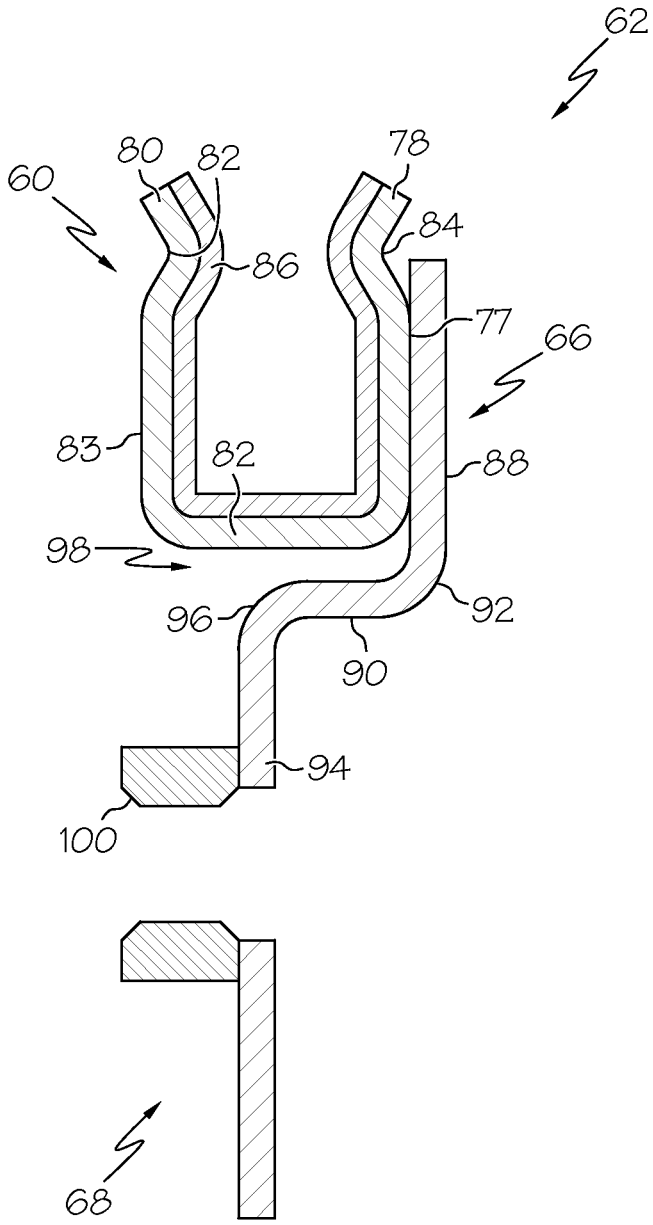
FIG. 4 is a section view of a support bracket for use with the window support bracket assembly of FIG. 3 according to one or more embodiments described herein.

Referring to FIG. 4, a section view of the support bracket 62 and the window support 60 is illustrated in isolation. The support bracket 62 includes the window support connecting portion 66 that connects to an inboard side 77 of sidewall 78 of the window support 60 and the lift arm bracket connecting portion 68 that extends downwardly from the window support connecting portion 66. In the illustrated embodiment, the window support 60 is in the form of a U-shaped channel including the sidewall 78, sidewall 80 with outboard side 83 and a bottom 82 extending between the sidewalls 78 and 80. One or both of the sidewalls 78 and 80 may include a notch 82 and 84 forming a necked-down region that can be received by the vehicle window 16 (FIG. 1) for retaining and stabilizing the vehicle window 16 within the window support 60. In some embodiments, an adhesive layer 86 may be provided within the U-shaped channel for adhering the vehicle window 16 between the sidewalls 78 and 80 of the window support 60.

The support bracket 62 is connected at the sidewall 78 of the window support 60 at the window support connecting portion 66. The window support connecting portion 66 may include an upwardly extending portion 88 that extends alongside the sidewall 78. The lift arm bracket connecting portion 68 includes a downwardly extending portion 94 that extends downwardly in a direction somewhat opposite of the window support connecting portion 66. The window support connecting portion 66 is connected to the lift arm bracket connecting portion 68 by an underhang portion 90 that underhangs the bottom 82 of the window support 60. The underhang portion 90 may extend somewhat horizontally between the window support connecting portion 66 and the lift arm bracket connecting portion 68. The underhang portion 90 may underhang only a portion (e.g., 90 percent or less, such as 75 percent or less, such as 50 percent or less, such as 40 percent or less) of the width of the bottom 82 of the window support 60 and is connected to the upwardly extending portion 88 at an outer bend 92 and to the downwardly extending portion 94 at an inner bend 96. The inner bend may be located beneath the bottom 82 of the window support 60. In some embodiments, such as the one shown, the underhang portion 90 is spaced from the bottom 82 of the window support 60 providing a gap 98 between the underhang portion 90 and the bottom 82. The outer bend 92 may be located below or spaced from the bottom 82 of the window support 60 to provide the gap 98.

The downwardly extending portion 94 of the lift arm bracket connecting portion 68 may include a fastener receiving structure 100 (e.g., a weld nut) that extends outwardly from the downwardly extending portion 94. The fastener receiving structure 100 may also underhang the bottom 82 of the window support 60. As can be seen, the downwardly extending portion 94 may be located below the bottom 82 of the window support 60 and between the outboard and inboard sides 83 and 77 such that no portion of the downwardly extending portion 94 extends horizontally beyond the bottom 82 or the outboard side 83 of the window support 60. A portion of the fastener receiving structure 100 may extend outwardly beyond the outboard side 83. For example, no more than about 25 percent, such as no more than about 15 percent, such as between about 30 and about 5 percent of a length of the fastener receiving structure 100 may extend outwardly beyond the outboard side 83.

Figure 5:
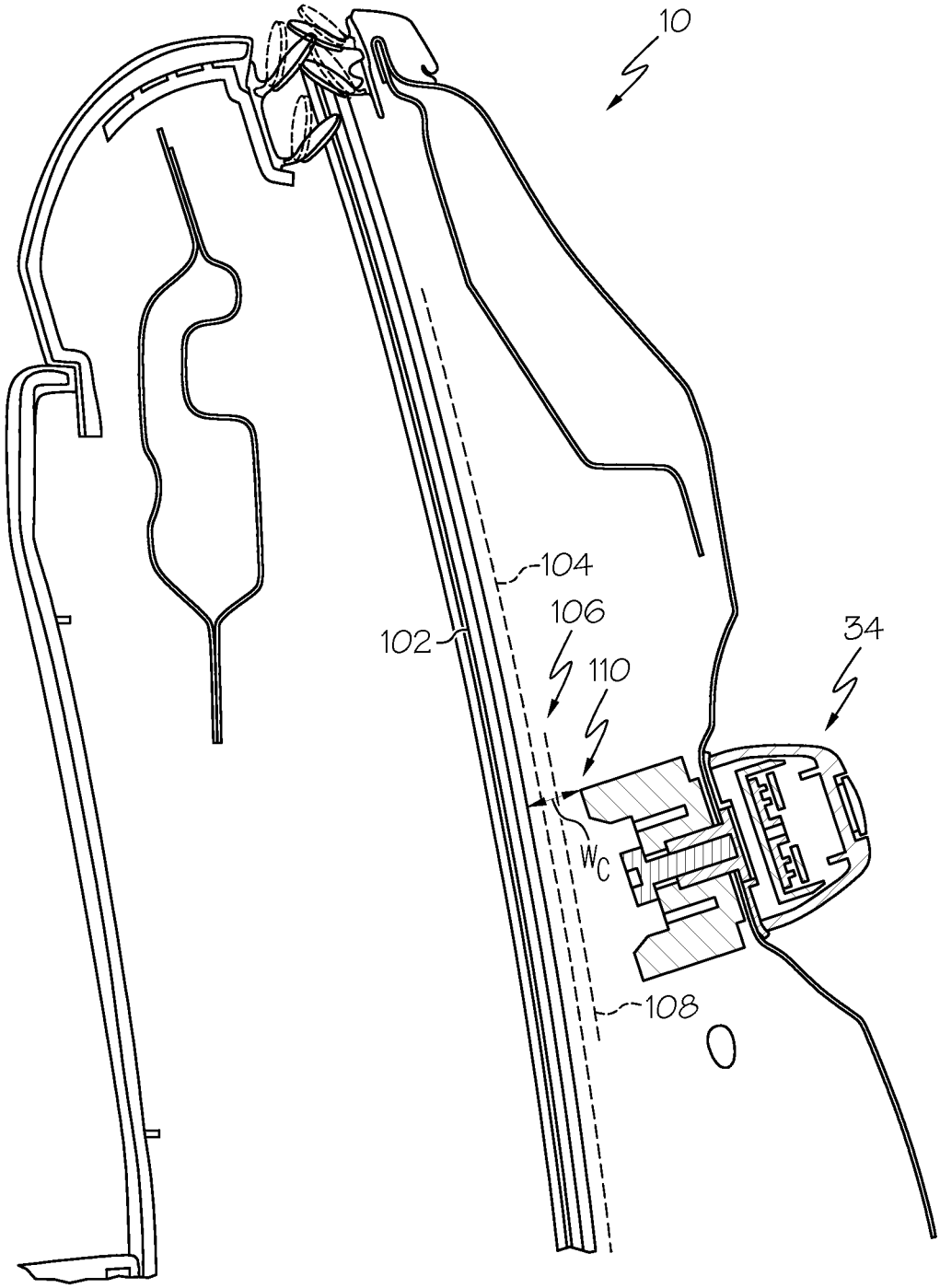
FIG. 5 illustrates a simplified view of the door assembly of FIG. 1.

As indicated above, the window support bracket assembly 30 is shaped and sized to provide clearance between the window support bracket assembly 30 and components within the door assembly 10, while providing suitable support for the vehicle window 16 as the vehicle window 16 is moved between the raised and lowered positions using the window regulator assembly 18. FIG. 5 illustrates a simplified, section view of the door assembly 10 with the door handle assembly 34 and a window guide channel 102. In some embodiments, the vehicle window 16 may travel in a somewhat arcuate path, as indicated by the shape of the window guide channel 102, between the raised and lowered positions. In some embodiments, the vehicle window 16 may also be curved (i.e., non-planar).

Dotted line 104 indicates a locus of an outermost point of the window support 60 as the window support 60 travels between the raised and lowered positions. As can be seen, a gap 106 is provided between the line 104 and an innermost point of the door handle assembly 34. Dotted line 108 indicates a locus of an outermost point of the fastener receiving structure 100 as the fastener receiving structure 100 travels between the raised and lowered positions. As can be seen a gap 110 is provided between the line 108 and the innermost point of the door handle assembly 34. In some embodiments, the width of the gap 110 is no more than about 50 percent, such as no more than about 40 percent, of a width Wc from the innermost point of the door handle assembly 34 to the window guide channel 102.

The window support 60 and support brackets 62 and 64 may be formed of any suitable materials, such as metals and/or plastics and using any suitable process or combination of processes such as stamping, bending, machining, molding, forging, etc. In some embodiments, the window support connecting portion 66, the lift arm bracket connecting portion 68 and the underhang portion 90 may all be formed of a single piece of material, such as a sheet of metal. The window support 60 may be formed separate of the support brackets 62 and 64 and then attached thereto, such as by welding and/or fastening. In other embodiments, the window support 60 may be formed of the same material forming the support brackets 62 and 64.

The above-described window support bracket assembly 30 provides support for the vehicle window 16 for moving the vehicle window 16 up and down between raised and lowered positions, while providing a narrow profile for clearance between the window support bracket assembly and components within the door assembly. The size and shape of the support brackets 62 and 64 can minimize the space needed within the door assembly 10 and attach the window support 60 to the window regulator assembly 18.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A window lift assembly for moving a vehicle window, comprising:

a window regulator assembly including an actuator that moves the vehicle window between raised and lowered positions;

a window support bracket assembly that connects the vehicle window and the window regulator assembly, the window support bracket assembly comprising:

a window support that supports the vehicle window, the window support including an outboard side and an inboard side; and a support bracket connected to the window support, the support bracket formed as a single unitary structure comprising a window support connecting portion connected to the inboard side of the window support and a lift arm bracket connecting portion extending below a bottom of the window support, wherein an underhang portion of the support bracket is connected to the window support connecting portion at an outer bend and is connected to the lift arm bracket connecting portion at an inner bend.

2. The window lift assembly of claim 1, wherein the outer bend is spaced from the inner bend.

3. The window lift assembly of claim 1, wherein the inner bend is located beneath the bottom of the window support and inboard of the outboard side of the window support.

4. The window lift assembly of claim 1, wherein the window support is a U-shaped channel.

5. The window lift assembly of claim 1, wherein a gap is provided between the underhang portion and the bottom of the window support.

6. The window lift assembly of claim 1, wherein the inner bend extends below the bottom of the window support.

7. The window lift assembly of claim 1 further comprising a fastener receiving structure connected to the lift arm bracket connecting portion.

8. The window lift assembly of claim 7, wherein the fastener receiving structure is located at an outboard side of the lift arm bracket connecting portion.

9. A vehicle comprising:

a door assembly comprising:

a door handle assembly;

a vehicle window; and a window lift assembly for moving the vehicle window, the window lift assembly comprising:

a window regulator assembly including an actuator that moves the vehicle window between raised and lowered positions;

a window support bracket assembly that connects the vehicle window and the window regulator assembly, the window support bracket assembly comprising:

a window support that supports the vehicle window, the window support including an outboard side and an inboard side; and a support bracket connected to the window support, the support bracket formed as a single unitary structure comprising a window support connecting portion connected to the inboard side of the window support and a lift arm bracket connecting portion extending below a bottom of the window support, wherein an underhang portion of the support bracket is connected to the window support connecting portion at an outer bend and is connected to the lift arm bracket connecting portion at an inner bend.

10. The vehicle of claim 9, wherein the outer bend is spaced from the inner bend.

11. The vehicle of claim 9, wherein the inner bend is located beneath the bottom of the window support and inboard of the outboard side of the window support.

12. The vehicle of claim 9, wherein the window support is a U-shaped channel.

13. The vehicle of claim 9, wherein a gap is provided between the underhang portion and the bottom of the window support.

14. The vehicle of claim 9, wherein the outer bend extends below the bottom of the window support to provide a gap between the underhang portion and the bottom of the window support.

15. The vehicle of claim 9 further comprising a fastener receiving structure connected to the lift arm bracket connecting portion.

16. The vehicle of claim 15, wherein the fastener receiving structure is located at an outboard side of the lift arm bracket connecting portion.

17. A window lift assembly for moving a vehicle window, comprising:

a window regulator assembly including an actuator that moves the vehicle window between raised and lowered positions;

a window support bracket assembly that connects the vehicle window and the window regulator assembly, the window support bracket assembly comprising:

a window support that supports the vehicle window, the window support including an outboard side and an inboard side; and a support bracket formed as a single unitary structure connected to the window support, the support bracket comprising:

a window support connecting portion connected to the inboard side of the window support; and a lift arm bracket connecting portion extending below a bottom of the window support;

wherein the lift arm bracket connecting portion is offset from the window support connecting portion toward the outboard side of the window support such that the lift arm bracket connecting portion is located between the outboard and inboard sides of the window support.

18. The window lift assembly of claim 17, wherein the support bracket further includes an underhang portion connected to the window support connecting portion at an outer bend and to the lift arm bracket connecting portion at an inner bend.

19. The window lift assembly of claim 18, wherein a gap is provided between the underhang portion and a bottom of the window support.

20. The window lift assembly of claim 18, wherein the outer bend extends below a bottom of the window support to provide a gap between the underhang portion and a bottom of the window support.

* * * * *